US005253705A

United States Patent [19]

Clary et al.

[11] Patent Number: 5,253,705

[45] Date of Patent: Oct. 19, 1993

[54] HOSTILE ENVIRONMENT PACKER SYSTEM

[75] Inventors: Sammy R. Clary; Michael R. Hutto, both of Jay, Fla.; Tommy L. Stambaugh, Celina, Tex.

[73] Assignee: Otis Engineering Corporation, Carrollton, Tex.

[21] Appl. No.: 865,904

[22] Filed: Apr. 9, 1992

[51] Int. Cl.[5] ..... E21B 23/06

[52] U.S. Cl. ..... 166/123; 166/134

[58] Field of Search ..... 166/123, 134, 182, 387

[56] References Cited

U.S. PATENT DOCUMENTS

| | | | |
|---|---|---|---|
| 4,288,082 | 9/1981 | Setterberg | 277/125 |
| 4,457,369 | 7/1984 | Henderson | 166/125 |
| 4,572,290 | 2/1986 | Clitton | 166/123 |
| 4,830,103 | 5/1989 | Blackwell et al. | 166/123 X |
| 4,898,245 | 2/1990 | Braddick | 166/387 |
| 4,972,908 | 11/1990 | Braddick | 166/387 |

*Primary Examiner*—William P. Neuder

*Attorney, Agent, or Firm*—Ross, Howison, Clapp & Korn

[57] ABSTRACT

A well packer isolation system (10) for use in hostile, corrosive environments is disclosed that comprises packer top sub (20), packer mandrel (22), setting sleeve (24), top slip support (26), slip (28), wedge (30), packer elements (32A, 32B, 32C), packer bottom sub (34), and shear pins (36, 38, 40, 42). As packer system (10) is run into an existing polished bore receptacle (12) using running tool (14), bottom sub (34) no-goes against PBR adapter sub (76). When sufficient setting pressure is exerted on setting sleeve (24) by running tool (14), shear pins (36, 38, 40) are sheared, packer elements (32A, 32B, 32C) are longitudinally compressed and radially expanded, and slip (28) engages inside wall (56) of PBR (12). Running tool (14) is withdrawn after packer system (10) is set by upwardly shearing shear pins (42).

13 Claims, 3 Drawing Sheets

HOSTILE ENVIRONMENT PACKER SYSTEM

BACKGROUND OF THE INVENTION

1. Field of the Invention

This invention relates to packer systems for use in oil and gas wells, and more particularly, to a packer system adapted to be run into a well bore and installed inside a polished bore receptacle (PBR) to isolate an existing but malfunctioning PBR system.

2. Description of Related Art

Downhole packer systems have previously been disclosed, for example, in U.S. Pat. Nos. 4,288,082, 4,457,369, 4,898,245 and 4,972,908. Packer systems are typically used for blocking fluid flow through an annulus defined by production tubing disposed within a casing string. Because formation fluids can be highly corrosive and/or hot, tubing strings are frequently used to protect the casing from formation fluids as they flow from a producing zone to the well surface.

U.S. Pat. No. 4,288,082 discloses a well sealing system designed to be run on a tubing string in a casing system having restrictions that are adapted to engage and support the guide sleeve and protective cylinder of the packer assembly. The packer is set by the weight of the tubing string acting on slips disposed above elastomeric packing elements, causing the slips to engage the interior wall of the casing.

U.S. Pat. No. 4,457,369 discloses a retrievable well packer designed for use at high temperatures and pressures that is explosively set by a running tool and then connected to a tubing string. The well packer has a tubular mandrel; upper and lower slips in spaced relation on the mandrel, each comprising a one piece, C-shaped member; means on the mandrel for expanding each of the slips; means for locking the upper slips in expanded condition; and an expandable seal assembly disposed on the mandrel between the slips. The slip assemblies are arranged so that the lower slip assembly sets first and the upper slip assembly last, while the upper slip assembly releases first and the lower slip assembly releases last when pulling the packer.

U.S. Pat. No. 4,972,908 discloses a packer arrangement wherein the operating string is released from the tubular member on which the packer is supported before the packer can be expanded into sealing position. Means for locking tubular members against relative longitudinal movement are disclosed to prevent premature expansion of the packer into sealing position. Actuation can be accomplished by hydraulic action alone, mechanical action alone, or a combination of mechanical and hydraulic action.

U.S. Pat. No. 4,898,245 discloses a packer arrangement that can be used as a permanent production packer or as a retrievable packer in well bore tubulars. The packer can be hydraulically, mechanically or explosively set, and can be retrieved by wireline or coiled tubing. Use of the packer arrangement in a casing having a liner with a packer bore receptacle is also disclosed, with the packer arrangement being connected to a landing nipple secured inside the liner.

A packer system is needed, however that can be installed in a casing and polished bore receptacle assembly to isolate an existing but malfunctioning packer system without the need for a landing nipple as required by the invention disclosed in U.S. Pat. No. 4,898,245.

SUMMARY OF THE INVENTION

According to the present invention, a packer system is provided that has no metal components other than those associated strictly with the deployment of the element package and the mandrel exposed to production fluids. The element package isolates the upper internal and external slip arrangement from these potentially corrosive well fluids, allowing them to be manufactured from standard materials.

The packer system of the invention is preferably designed to no-go on a liner tie-back type of polished bore receptacle or other similarly arranged PBR. Once the packer no-goes, a compressive force transmitted by the tubing string acts to squeeze and set the element package and deploy the external slips. Once the external slips are set and anchored into the casing wall, any upward movement which might allow the packer to become unset is prevented by the internal slip arrangement, which traps the setting stroke by engaging the mandrel.

When the element package is fully set, it provides an effective seal between the casing wall and the packer mandrel, thus isolating the external and internal slip arrangement from potentially corrosive well fluids. The running tool which is used to run and set the packer system is designed to shear down when the packer has no-goed and thus initiate and complete the setting action. Once the packer is set, the running tool provides a positive indication of the packer setting by means of an upward shear-off feature.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1A:
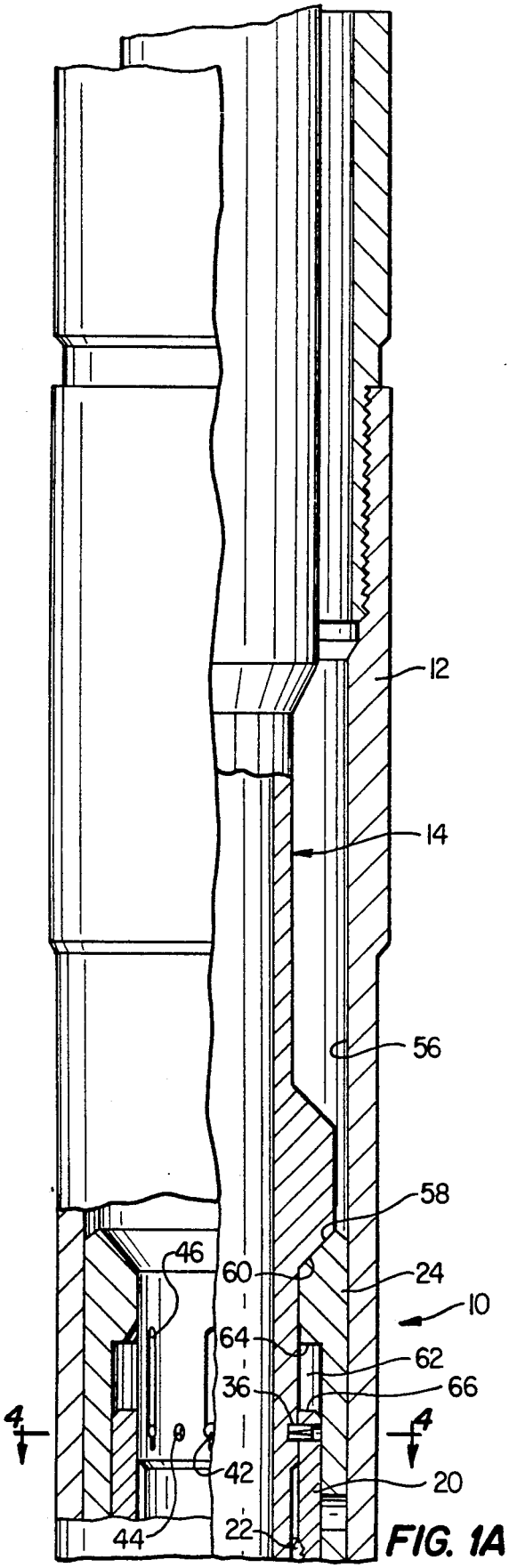
FIGS. 1A, 1B and 1C together comprise an elevation view, partially in section and partially broken away, of the packer isolation system of the invention as it is run into a packer bore receptacle.
Figure 1B:
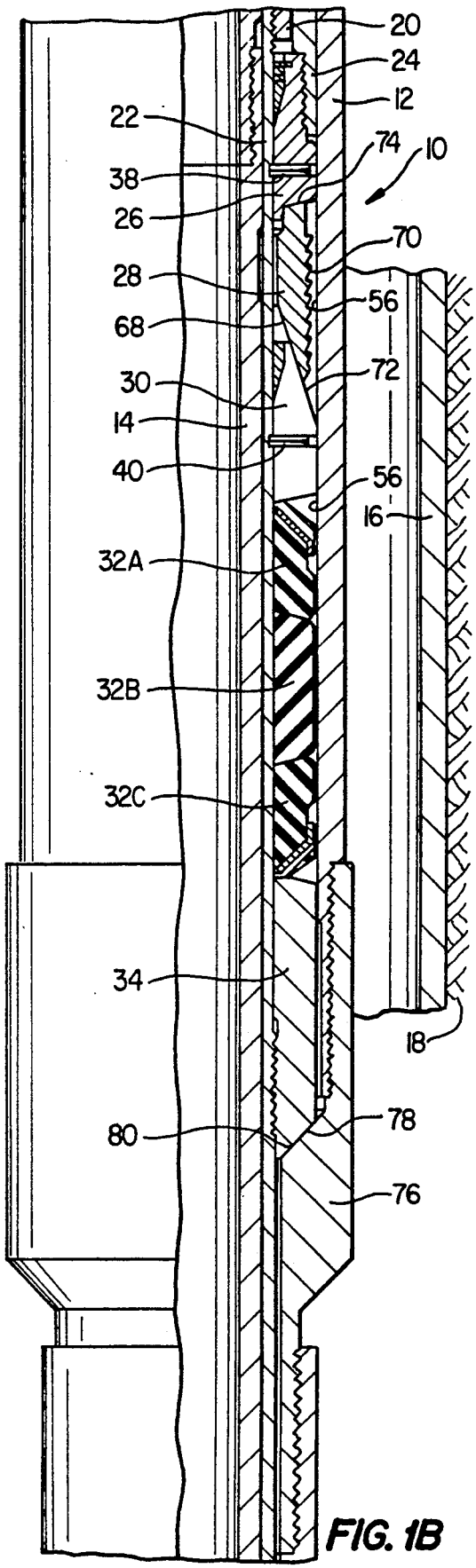
Figure 1C:
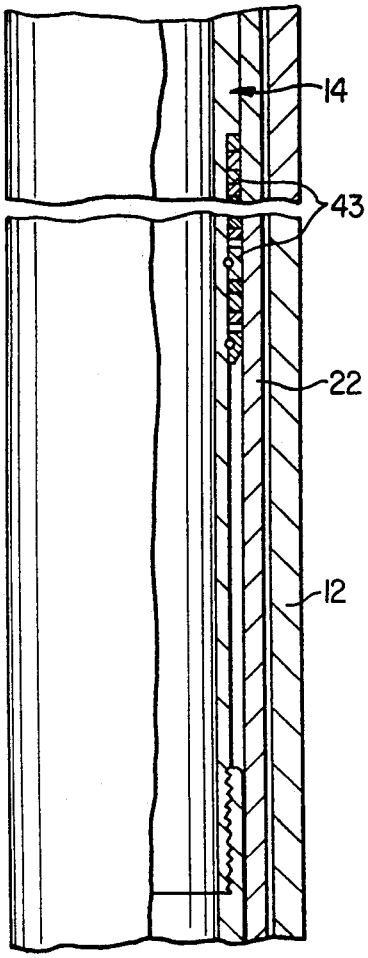

Referring to FIGS. 1A, 1B and 1C, packer system 10 of the invention is depicted in the form that it is run into an existing casing liner/polished bore receptacle assembly ("PBR") 12 using running tool 14 connected to a tubing string (not shown). PBR 12 can be installed inside casing 16 in well bore 18 by conventional means. According to a preferred embodiment of the invention, packer system 10 is designed to no-go on a liner tie-back type of PBR or other similarly arranged PBR, as discussed in more detail below.

Packer system 10 preferably comprises packer top sub 20, packer mandrel 22, setting sleeve 24, top slip support 26, slip 28, wedge 30, packer elements 32A, 32B, 32C, packer bottom sub 34, and shear pins 36, 38, 40, 42. It should be understood throughout this disclosure that although only one of shear pins 36, 38, 40 and 42 may be visible in a particular figure of the drawings, a plurality of such shear pins are preferably used in each instance, and are circumferentially spaced around packer system 10.

Figure 4:
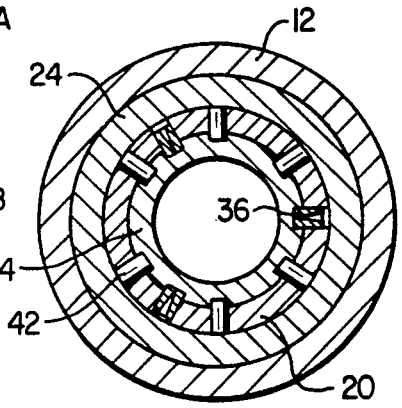
FIG. 4 is a cross-sectional view taken along line 4—4 of FIG. 1A.

Referring to FIGS. 1A and 4, running tool 14 is connected to packer top sub 20 by a plurality of circumferentially spaced shear pins 36, 42. Shear pins 36 are disposed in holes 44 in running tool 14, thereby preventing relative longitudinal motion between running tool 14 and top shear sub 20 until shear pins 36 are sheared. Shear pins 42 are disposed in longitudinally extending slots 46 in running tool 14, thereby permitting a limited range of relative longitudinal motion between running tool 14 and packer top sub 20 from the time shear pins 36 are sheared until shear pins 42 are sheared. Packer top sub 20 is threaded onto the upwardly extending end of packer mandrel 22, and relative longitudinal motion between packer mandrel 22 and running tool 14 is therefore also limited by shear pins 36 as packer system 10 is run into PBR 12. Lower seals 43 are desirably provided between running tool 14 and packer mandrel 22.

Setting sleeve 24 surrounds running tool 14 and packer top sub 20, and slidably engages inside wall 56 of PBR 12 as shown in FIGS. 1A and 1B. While packer system 10 is being run into PBR 12, beveled shoulder 60 of running tool 14 abuts against upwardly extending beveled shoulder 58 of setting sleeve 24. Although setting sleeve 24 is adapted to slide longitudinally relative to PBR 12, packer top sub 20 and packer mandrel 22, such relative longitudinal movement is prevented during insertion of packer system 10 into PBR 12 by shear pins 36, 38. The downwardly extending end of setting sleeve 24 is threaded onto top slip support 26.

Relative longitudinal motion between setting sleeve 24 and running tool 14 is initially limited by shear pins 38 connecting top slip support 26 to packer mandrel 22, which is threadedly connected to packer top sub 20, and therefore pinned to running tool 14 by shear pins 36 as previously described.

Slip 28 is preferably a conventional, radially expandable C-ring slip similar to that disclosed in U.S. Pat. No. 4,457,369, having an inwardly facing inclined surface section 68, outwardly facing teeth 70, and an upwardly facing surface 74 abutting against the bottom of top slip support 26. Wedge 30, a ring member having an outwardly facing, conically inclined surface 72 that slidably engages inclined surface section 68 of slip 28, is disposed beneath slip 28 and is initially pinned to packer mandrel 22 by shear pins 42. Packer elements 32A, 32B and 32C surrounding packer mandrel 22 are conventional elastomeric compression packers that, when compressed, are adapted to provide sealing engagement with inside wall 56 of PBR 12. Packer bottom sub 34 is threaded onto packer mandrel 22, and provides bottom support during the compression and radial expansion of slip 28 and packer elements 32A, 32B and 32C.

Figure 2A:
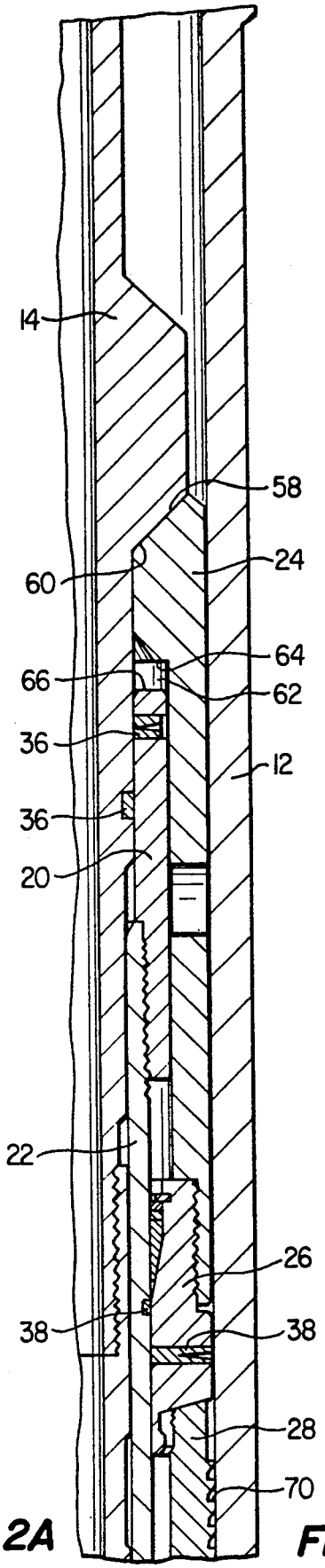
FIGS. 2A and 2B together comprise a one quarter sectional elevation view of that portion of the packer system shown in FIGS. 1A and 1B, with the slip and packer elements shown in the set position within the polished bore receptacle and, the running tool still engaged.
Figure 2B:
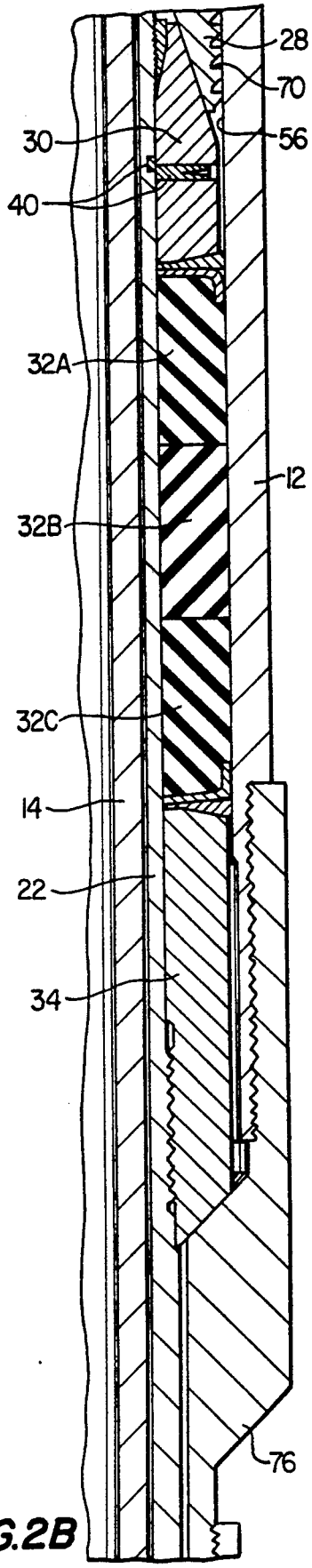
Figure 3A:
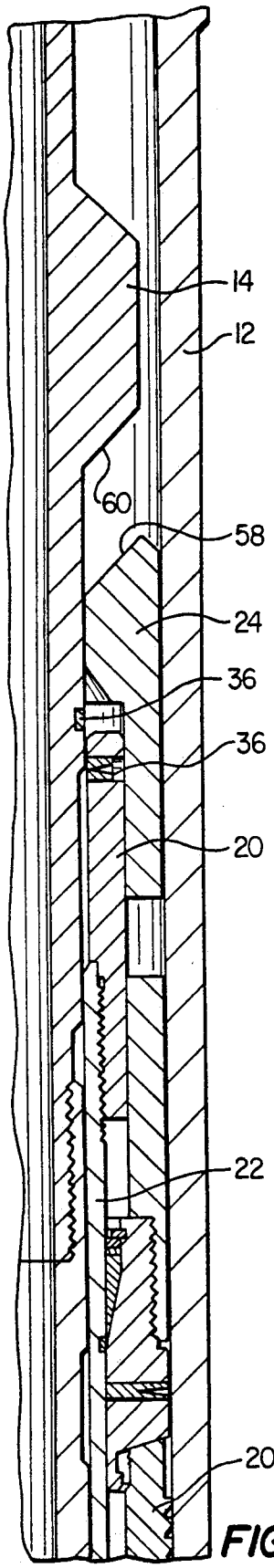
FIGS. 3A and 3B together comprise a one quarter sectional elevation view of that portion of the packer system shown in FIGS. 2A and 2B, with the slip and packer elements shown in the set position within the polished bore receptacle and the running tool disengaged.
Figure 3B:
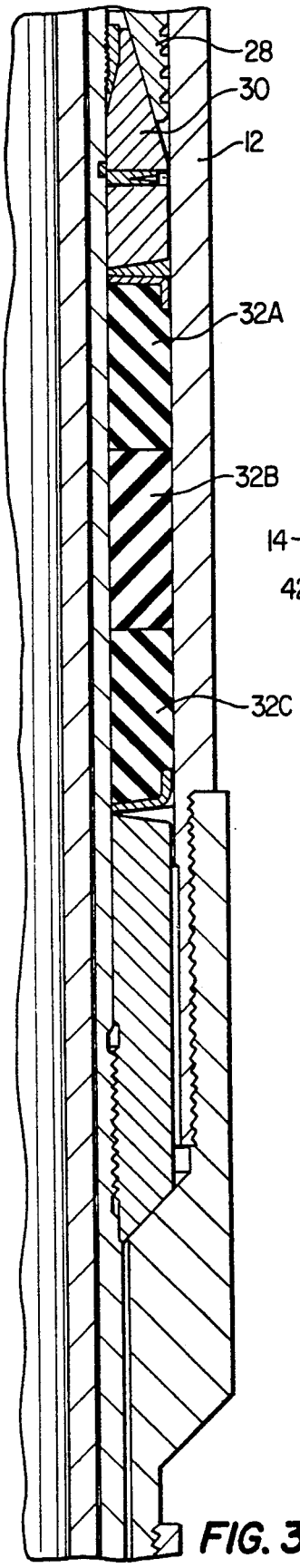

As packer system 10 is run into PBR 12 on running tool 14, bottom shoulder 78 of packer bottom sub 34 contacts no-go surface 80 inside PBR adapter sub 76, preventing further downward travel of packer mandrel 22 to which packer bottom sub 34 is threadedly connected. When sufficient setting pressure is thereafter exerted downwardly through the tubing string by beveled shoulder 60 of running tool 14 on setting sleeve 24, shear pins 36, 38 and 40 are sheared, as shown in FIGS. 2A and 2B. Running tool 14, setting sleeve 24 and top slip support 26 are driven downward relative to packer top sub 20 and packer mandrel 22, causing slots 46 (visible in FIG. 1A) to slide downwardly past shear pins 42 as annular shoulder 64 of setting sleeve 24 moves closer to top end 66 of packer top sub 20, reducing the length of annular space 62 therebetween.

As top slip support 26 moves downward relative to packer mandrel 22 and PBR 12, slip 28 is forced downward over wedge 30. As slip 28 moves downward over wedge 30, teeth 70 are forced radially outward into contact with inside wall 56 of PBR 12 as shown in FIGS. 2A and 2B. Because teeth 70 are configured to slide downwardly against inside wall 56, but to bite into the wall when moved upwardly relative to inside wall 56, application of the downward force also causes wedge 30 to move downwardly, longitudinally compressing packer elements 32A, 32B and 32C, and causing them to expand radially into sealing engagement with inside wall 56 of PBR 12.

Once packer elements 32A, 32B and 32C are longitudinally compressed and radially expanded, and the downward pressure is relaxed, teeth 70 of slip 28 bite into inside wall 56 of PBR 12, preventing subsequent upward movement of packer bottom sub 34 and packer mandrel 22 relative to PBR 12. Packer system 10 is thereby set inside PBR 12, and running tool 14 can be withdrawn.

The withdrawal of running tool 14 from packer system 10 is described in relation to FIGS. 1A, 1B, 3A, 3B and 4. As running tool 14 is drawn upwardly relative to top sub 20, packer mandrel 22 and PBR 12, beveled shoulder 60 of running tool 14 moves away from beveled shoulder 58 of setting sleeve 24, and slots 46 as shown in FIG. 1A slide upwardly until the bottom edges of slots 46 engage shear pins 42. A further application of upwardly directed force sufficient to break shear pins 42 releases running tool 14 from packer system 10, permitting running tool 14 to be withdrawn to the surface. As running tool 14 is withdrawn, teeth 70 of slip 28 and packer elements 32A, 32B and 32C remain engaged with inside wall 56 of PBR 12.

The novel packer system disclosed herein is particularly useful in hostile environments because it provides means for isolating casing/liner components below the packer, means for isolating the internal and external slip components from corrosive well fluids, thereby reducing the chances of packer failure due to corrosion, and shear means for releasing the running tool and giving a positive indication at the rig floor that the packer is set.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A packer system adapted to be installed inside a polished bore receptacle using a running tool suspended on a tubing string inside an oil or gas well, the packer system comprising:

first shearable means for connecting the packer system in fixed longitudinal relation to the running tool;

second shearable means for connecting the packer system in sliding longitudinal relation to the running tool over a limited range of travel;

a mandrel;

bottom support means connected to the mandrel for engaging the polished bore receptacle to limit downward motion of the packer system relative to the polished bore receptacle;

a plurality of elastomeric packer elements disposed on the mandrel;

compression means disposed above the packer elements for setting the packer elements by longitudinally compressing the packer elements against the bottom support means to radially expand the packer elements into sealing engagement with the polished bore receptacle;

means for communicating a downwardly exerted compressive force from the running tool to the compression means;

third shearable means for connecting the mandrel to the compression means; and means disposed above the packer elements for preventing upward movement of the compression means relative to the polished bore receptacle after the packer elements are set.

2. The packer system of claim 1 wherein the running tool comprises an outer wall having a plurality of circumferentially spaced cylindrical recesses and the first shearable means comprises a plurality of circumferentially spaced shear pins extending radially into the recesses.

3. The packer system of claim 1 wherein the running tool comprises an outer wall having a plurality of circumferentially spaced, longitudinally extending slots and the second shearable means comprises a plurality of circumferentially spaced shear pins extending radially into the slots.

4. The packer system of claim 1 wherein the polished bore receptacle comprises an inwardly extending annular shoulder and the bottom support means comprises a packer bottom sub having an outwardly extending annular shoulder adapted to abut against the annular shoulder of the polished bore receptacle.

5. The packer system of claim 1 wherein the compression means comprises slidably engaged slip and wedge members.

6. The packer system of claim 1 wherein the means for communicating the compressive force from the running tool to the compression means is a setting sleeve that is slidably disposed around the mandrel and further comprises means for abutting against the running tool.

7. The packer system of claim 1 wherein the mandrel comprises a plurality of outwardly facing recesses and the third shearable means comprises a plurality of circumferentially spaced shear pins extending radially into the recesses from the compression means.

8. The packer system of claim 1 wherein the means disposed above the packer elements for preventing upward movement of the compression means relative to the polished bore receptacle after the packer elements are set are a plurality of teeth extending radially outward from the compression means.

9. A well packer isolation system adapted for installation in an existing polished bore receptacle in a subterranean by a running tool suspended from a tubing string, the system comprising:

a packer mandrel;

means disposed around the packer mandrel for no-going the system in the polished bore receptacle;

at least one radially expandable, elastomeric packer element disposed around the packer mandrel;

slip means disposed above the packer element;

longitudinally slidable setting means disposed around the mandrel for exerting a downwardly directed force against the slip means;

means for delivering a downwardly directed force to the setting means;

means for maintaining the packer element in a radially expanded position after delivery of the downwardly directed force against the slip means;

first downwardly shearable means for preventing relative longitudinal movement between the packer and the slip means prior to no-going the system in the polished bore receptacle;

second downwardly shearable means for preventing relative longitudinal movement between the packer mandrel and the running tool prior to no-going the system in the polished bore receptacle; and upwardly shearable means for releasing the system from the running tool after installation of the system in the polished bore receptacle.

10. The well packer isolation system of claim 9 wherein the means for delivering a downwardly directed force to the setting means is an annular shoulder abutting the running tool.

11. The well packer isolation system of claim 9 wherein the first downwardly shearable means for preventing relative longitudinal movement between the packer and the slip means prior to no-going the system in the polished bore receptacle comprises a plurality of circumferentially spaced shear pins.

12. The well packer isolation system of claim 9 wherein the second downwardly shearable means for preventing relative longitudinal movement between the packer mandrel and the running tool prior to no-going the system in the polished bore receptacle comprises a plurality of circumferentially spaced shear pins.

13. The well packer isolation system of claim 9 wherein the upwardly shearable means for releasing the system from the running tool after installation of the system in the polished bore receptacle comprises a plurality of circumferentially spaced shear pins limiting relative longitudinal movement between the packer mandrel and running tool.

* * * * *